US005320766A

United States Patent [19]

Habeeb et al.

[11] Patent Number: 5,320,766

[45] Date of Patent: Jun. 14, 1994

[54] LUBRICANT COMPOSITION CONTAINING ALKOXYLATED AMINE SALT OF A DIHYDROCARBYLDITHIOPHOSPHORIC ACID

[75] Inventors: Jacob J. Habeeb; Morton Beltzer, both of Westfield, N.J.

[73] Assignee: Exxon Research and Engineering Company, Florham Park, N.J.

[21] Appl. No.: 21,292

[22] Filed: Feb. 22, 1993

[51] Int. Cl.[5] ..... C10M 105/74

[52] U.S. Cl. ..... 252/32.7 R; 252/51.5 R

[58] Field of Search ..... 252/32.7 E, 32.9 R, 252/51.5 R

[56] References Cited

U.S. PATENT DOCUMENTS

| | | | |
|---|---|---|---|
| 2,737,492 | 3/1956 | Beegle et al. | 252/32.7 |
| 3,769,211 | 10/1973 | Hamblin et al. | 252/32 FE |
| 3,997,454 | 12/1976 | Adams | 252/18 |
| 4,089,790 | 5/1978 | Adams | 252/18 |
| 4,132,657 | 1/1979 | Verdicchio et al. | 252/32.5 |
| 4,163,729 | 8/1979 | Adams | 252/18 |
| 4,244,827 | 1/1981 | Michaelis et la. | 252/46.4 |
| 4,557,845 | 12/1985 | Horodysky et al. | 252/49.9 |
| 4,721,802 | 1/1988 | Forsberg | 558/207 |
| 4,774,351 | 9/1988 | Forsberg | 558/207 |
| 4,917,809 | 4/1990 | Zinke et al. | 252/32.7 E |
| 4,965,002 | 10/1990 | Brannen et al. | 252/32.5 |
| 5,080,813 | 1/1992 | Kammann et al. | 252/32.7 R |

*Primary Examiner*—Prince Willis, Jr.
*Assistant Examiner*—Cephia D. Toomer
*Attorney, Agent, or Firm*—James H. Takemoto

[57] ABSTRACT

A lubricating oil composition having improved antiwear, antioxidancy and fuel economy properties which comprises a lubricating oil basestock and an alkoxylated amine salt of a dihydrocarbyldithiophosphoric acid of the formula

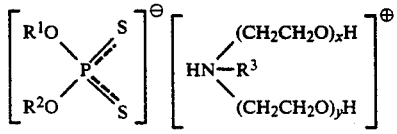

(I)

where $R^1$ and $R^2$ are each independently hydrocarbyl groups having from to 30 carbon atoms, $R^3$ is a hydrocarbyl group of 2 to 22 carbon atoms, x and y are each independently integers from 1 to 15 with the proviso that the sum of x+y is from 2 to 20.

5 Claims, No Drawings

LUBRICANT COMPOSITION CONTAINING ALKOXYLATED AMINE SALT OF A DIHYDROCARBYLDITHIOPHOSPHORIC ACID

BACKGROUND OF THE INVENTION

1. Field of the Invention

This invention relates to a lubricant composition containing an alkoxylated amine salt of a dihydrocarbyldithiophosphoric acid and its use to improve fuel economy in an internal combustion engine.

2. Description of the Related Art

In order to protect internal combustion engines from wear, engine lubricating oils have been provided with antiwear and antioxidant additives. The primary oil additive for the past 40 years for providing antiwear and antioxidant properties has been zinc dialkyldithiophosphate (ZDDP). For example, U.S. Pat. No. 4,575,431 discloses a lubricating oil additive composition containing dihydrocarbyl hydrogen dithiophosphates and a sulfur-free of hydrocarbyl dihydrogen phosphates and dihydrocarbyl hydrogen phosphates, said composition being at least 50% neutralized by a hydrocarbyl amine having 10 to 30 carbons in said hydrocarbyl group. U.S. Pat. No. 4,089,790 discloses an extreme-pressure lubricating oil containing (1) hydrated potassium borate, (2) an antiwear agent selected from (a) ZDDP, (b) an ester, an amide or an amine salt of a dihydrocarbyl dithiophosphoric acid or (c) a zinc alkyl aryl sulfonate and (3) an oil-soluble organic sulfur compound.

Oil additive packages containing ZDDP have environmental drawbacks. ZDDP adds to engine deposits which can lead to increased oil consumption and emissions. Moreover, ZDDP is not ash-free. Various ashless oil additive packages have been developed recently due to such environmental concerns.

It would be desirable to have a lubricating oil additive which provides excellent antioxidant antiwear, fuel economy and environmentally beneficial (less fuel, i.e., less exhaust emissions) properties.

SUMMARY OF THE INVENTION

This invention relates to alkoxylated amine salts of dihydrocarbyldithiophosphoric acids in lubricating oils to improve fuel economy wear protection and antioxidancy of lubricating oils used in an internal combustion engine. The lubricating oil composition comprises a major amount of a lubricating oil basestock and a minor amount of an alkoxylated amine salt of a dihydrocarbyldithiophosphoric acid, said salt having the formula

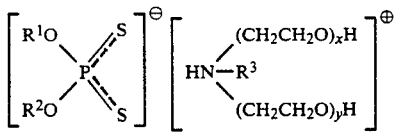

(I)

where $R^1$ and $R^2$ are each independently hydrocarbyl groups having from 3 to 30 carbon atoms, $R^3$ is a hydrocarbyl group having from 2 to 22 carbon atoms, and x and y are each independently integers of from 1 to 15 with the proviso that the sum of x+y is from 2 to 20. In another embodiment there is provided a method for improving fuel economy in an internal combustion engine which comprises operating the engine with lubricating oil containing an amount effective to improve fuel economy of an amine salt of the formula (I).

DETAILED DESCRIPTION OF THE INVENTION

In the lubricating oil composition of the present invention, the lubricating oil will contain a major amount of a lubricating oil basestock. The lubricating oil basestock are well known in the art and can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal and shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl -, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The amine salts of dihydrocarbyldithiophosphoric acids are prepared from the reaction of alkoxylated, preferably propoxylated or ethoxylated, especially ethoxylated amines with dihydrocarbyldithiophosphoric acids. Preferred ethoxylated amines used to prepare amine salts have the formula

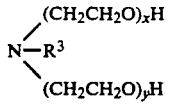

where $R^3$ is a hydrocarbyl group of from 2 to 22 carbon atoms, preferably 6 to 18 carbon atoms. The hydrocarbyl groups include aliphatic (alkyl or alkenyl) groups which may be substituted with hydroxy, mercapto and amino, and the hydrocarbyl group may be interrupted by oxygen, nitrogen or sulfur. The sum of x+y is preferably 2 to 15. Ethoxylated and/or propoxylated amines are commercially available from Sherex Chemicals under the trade name Varonic ® and from Akzo Corporation under the trade names Ethomeen ®, Ethoduomeen ® and Propomeen ®. Examples of preferred amines containing from 2 to 15 ethoxy groups include ethoxylated (5) cocoalkylamine, ethoxylated (2) tallowalkylamine, ethoxylated (15) cocoalkylamine and ethoxylated (5) soyaalkylamine.

Preferred dihydrocarbyldithiophosphoric acids used to react with alkoxylated amines to form amine salts have the formula

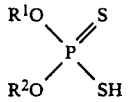

where $R^1$ and $R^2$ are independently hydrocarbyl groups having from 3 to 30 carbon atoms, preferably 3-20 carbon atoms. Such hydrocarbyl groups include aliphatic (alkyl or alkenyl) and alicyclic groups. The aliphatic and alicyclic groups may be substituted with hydroxy, alkoxy, cyano, nitro and the like and the alicyclic group may contain O, S or N as hetero atoms. Especially preferred are dialkyldithiophosphoric acid made from mixed (85%) 2-butyl alcohol and (15%) isooctyl alcohol (mixed primary and secondary alcohol s ). Dihydrocarbyldithiophosphoric acids are commercially available from Exxon Chemical Company.

The amine salts are prepared by methods known to those skilled in the art. Approximately equimolar amounts of alkoxylated amine and dihydrocarbyldithiophosphoric acid are mixed together in an acid/base neutralization reaction. The amounts of acid or base may be varied to achieve the desired acid/base balance of the final amine salt.

The lubricant oil composition according to the invention comprises a major amount of lubricating oil basestock and an amount effective to increase fuel economy of amine salt. Typically, the amount of amine salt will be from about 0.1 wt.% to about 5.0 wt.%, based on oil basestock. Preferably, the amount of amine salt is from about 0.5 wt.% to about 2.0 wt.%.

If desired, other additives known in the art may be added to the lubricating oil basestock. Such additives include dispersants, other antiwear agents, other antioxidants, corrosion inhibitors, detergents, pour point depressants, extreme pressure additives, viscosity index improvers, friction modifiers, and the like. These additives are typically disclosed, for example in "Lubricant Additives" by C. V. Smalhear and R. Kennedy Smith, 1967, pp. 1-11 and in U.S. Pat. No. 4,105,571, the disclosures of which are incorporated herein by reference.

The lubricating oil composition of the invention is further illustrated by the following examples which also illustrate a preferred embodiment.

EXAMPLE 1

Synthesis of Amine Salt 350 g of ethoxylated(5)cocoalkylamine was placed in a 3-neck round bottom flask fitted with a thermometer and a water cooled condenser. The amine was stirred and heated to 50° C. A stoichiometric amount of dioctyldithiophosphoric acid was then slowly titrated into the warm amine solution with stirring. The temperature was raised to 95° C. for 2 hours. The neutralization reaction was monitored with a pH meter. The addition of the acid was stopped at pH 7. After 2 hours of stirring at 95° C. the reaction product was cooled to room temperature and used without further purification.

EXAMPLE 2

Sequence VI Rapid Screener Test

The Sequence VI High Temperature Rapid Screener Test is a shortened version of the actual ASTM Sequence VI test for fuel economy. Although it uses the same engine as the Sequence VI, only the high temperature phase of the test is run. This emphasizes the boundary lubrication regime which basically determines the fuel economy capability of the additive. The test procedure is outlined below:

| Step # | Test Sequence | Time |
|---|---|---|
| 1 | Cool down / Warm up | 20 min |
| 2 | Detergent Flush to Candidate Oil | 1 hr, 20 min |
| 3 | Stabilize Step 1 - Stage 275° F. | 2 hr |
| 4 | BSFC Measurement Step 1 - Stage 275° F. | 30 min |
| 5 | Stabilize Step 2 - Stage 275° F. | 2 hr |
| 6 | BSFC Measurement Step 2 - Stage 275° F. | 30 min |

Each candidate oil run is preceded by a flush oil run to ensure that any "carry-over" effect is eliminated. The fuel economy of the candidate oil, as measured by brake specific fuel consumption (BSFC), is measured twice in the experiment. Once after a two hour stabilization, or break-in period, and then again after another two hour stabilization period. A base oil is run periodically throughout the test to determine the test precision. In this particular test the base oil was a commercially available SAE 5W-30 oil. The results are shown in the following table.

TABLE 1

| Oil | Additive | % Reduction in BSFC |
|---|---|---|
| SAE 5W-30 | — | Base case-assigned value of zero |
| SAE 5W-30 | 1% $C_{12}$ alkylamino:DDP* | 1.46 |
| SAE 5W-30 | 1% ethoxylated (5) cocoalkylamine:DDP from Example 1 | 5.14 |

*Prepared from Primene 81R ® cocoamine and dioctyldithiophosphoric acid.

The data i n Table I demonstrates that the ethoxylated amine:DDP salt shows an additional 72% improvement in BSFC over the corresponding non-ethoxylated amine:DDP salt.

What is claimed is:

1. A method for improving fuel economy of an internal combustion engine which comprises operating the engine with a lubricant oil composition comprising:

(a) a major amount of a lubricating oil basestock, and
(b) from 0.1 to 5 wt%, based on oil, of an ethoxylated amine salt of a dihydrocarbyldithiophosphoric acid, said salt having the formula

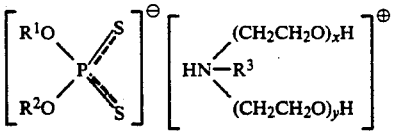

where $R^1$ and $R^2$ are each independently hydrocarbyl groups having from 3 to 30 carbon atoms, $R^3$ is a hydrocarbyl group of 2 to 22 carbon atoms, and x and y are each independently integers from 1 to 15 with the proviso that the sum of x+y is from 2 to 20.

2. The method of claim 1 wherein $R^3$ is alkyl or alkenyl of 6 to 18 carbon atoms.

3. The method of claim 1 wherein the sum of x+y is from 2 to 15.

4. The method of claim 1 wherein $R^3$ is substituted with OH, SH or $NH_2$ on the terminal carbon atom of the hydrocarbyl group.

5. The method of claim 1 wherein $R^1$ and $R^2$ are alkyl or alkenyl of from 3 to 20 carbon atoms.

* * * * *